US006064745A

United States Patent [19]

Avera

[11] Patent Number: 6,064,745

[45] Date of Patent: May 16, 2000

[54] COMPRESSION DRIVER PHASE PLUG

[75] Inventor: Donald Keith Avera, Toomsuba, Miss.

[73] Assignee: Peavey Electronics Corporation, Meridian, Mich.

[21] Appl. No.: 09/089,938

[22] Filed: Jun. 4, 1998

Related U.S. Application Data

[60] Provisional application No. 60/060,180, Sep. 26, 1997.

[51] Int. Cl.[7] ..... H04R 25/00

[52] U.S. Cl. ..... 381/343; 381/340; 181/159; 181/152

[58] Field of Search ..... 381/343, 340, 381/339, FOR 143; 181/159, 152

[56] References Cited

U.S. PATENT DOCUMENTS

| | | |
|---|---|---|
| 2,037,187 | 4/1936 | Wente . |
| 2,183,528 | 12/1939 | Blackburn . |
| 3,254,484 | 6/1966 | Kopper . |
| 4,143,738 | 3/1979 | Nakazono et al. . |
| 5,117,462 | 5/1992 | Bie . |
| 5,351,220 | 9/1994 | Noselli . |

FOREIGN PATENT DOCUMENTS

| | | | |
|---|---|---|---|
| 55-166396 | 12/1980 | Japan | 381/FOR 143 |
| 2-47998 | 2/1990 | Japan | 381/FOR 143 |
| 1514007 | 9/1976 | United Kingdom . | |
| 8904581 | 5/1989 | WIPO . | |

*Primary Examiner*—Curtis A. Kuntz
*Assistant Examiner*—Dionne N. Harvey
*Attorney, Agent, or Firm*—Watson Cole Grindle Watson, P.L.L.C.

[57] ABSTRACT

A phase plug for a horn loaded speaker has a frustro-conical body with a spherical entrance end and a planer outlet end. The plug is formed with radial channels. The entrance of the phase plug and the speaker diaphragm are conformal and the channels have generally equal aperture area from the entrance to the outlet, or slightly increasing aperture areas so as to minimize diffraction The truncation surface is defined by the intersection of the sidewalls of the conical body and the cone angle of the horn.

10 Claims, 3 Drawing Sheets

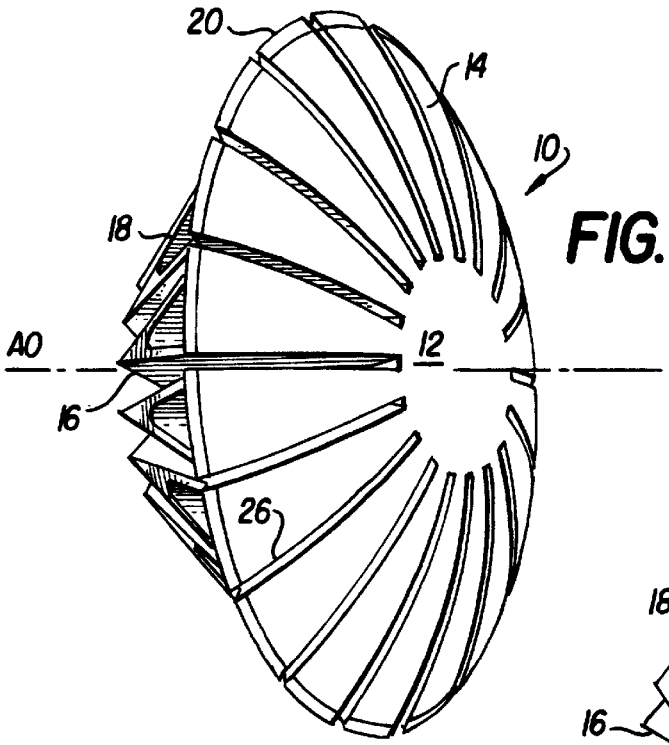
FIG. 1
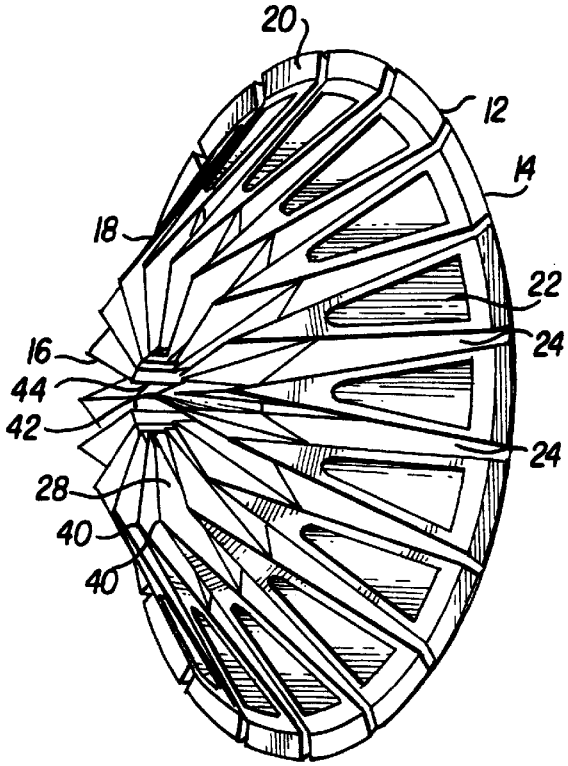
FIG. 2
FIG. 6A
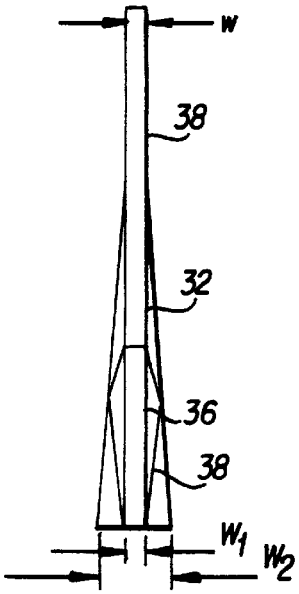
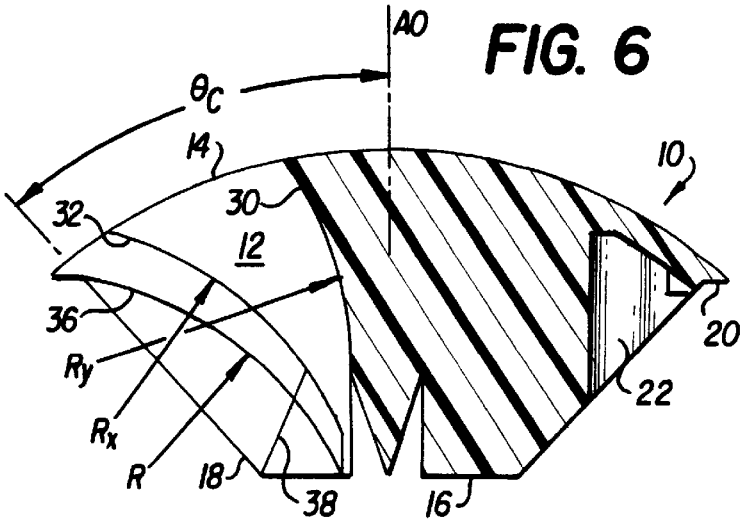
FIG. 6

COMPRESSION DRIVER PHASE PLUG

RELATED APPLICATION

This application is related to U.S. Provisional Application Ser. No. 60/060,180 filed Sep. 26, 1997, the teachings of which are interpreted here by reference.

BACKGROUND OF THE INVENTION

The invention pertains to a compression driver or phase plug, and particularly to a compression driver having substantially equal input and output aperture areas and substantially straight acoustical paths there between.

Compression drivers, on horn loaded loud speaker systems are known. The function of a phase plug within a compression driver is to provide an acoustic path which reduces out of phase acoustic signals and destructive cancellation or interference. However, efficient and satisfactory operation of such loud speaker systems is difficult to achieve.

In order to understand this, it is necessary to look at the acoustic principles involved. A compression driver is designed to increase the efficiency of a loud speaker by compressing the acoustical energy and transferring it through a channel to the throat of a horn. Many iterations of compression and channeling have been performed in the past. For instance, there are compression drivers with annular rings (circumferential slit), radial slits (tangerine-like sections) and hole array phase plugs. The purpose of the phase plug is to compress the audio and to equalize the acoustic path lengths to thereby minimize high frequency cancellations caused by phase differences. These prior arrangements have not resulted in a completely satisfactory transformation of the acoustic signal and in particular have not resulted in transformations without high frequency interference.

SUMMARY OF THE INVENTION

The invention relates to an acoustic transformer or phase plug having radial slits. In particular, the invention is directed to an improved phasing plug for a compression driver for a horn loaded loud speaker. The invention is based upon the discovery that such a transformer or phase plug is in the form of a frustro-conical body having an entrance surface in the form of a section of a sphere or spherical entrance surface converging towards a truncation or outlet surface along an acoustic axis. Conical walls of the body have outer wall portions which are perpendicular to the spherical surface, and the radial slits define an aperture area at the truncation or outlet surface which is greater than or equal to the aperture area of the radial slits at the spherical or entrance surface.

In a particular embodiment, the phase plug is employed in a speaker having a diaphragm in the form of a section of a sphere or spherical diaphragm which matches or is conformal with the shape of the spherical entrance surface. In the exemplary embodiment, the speaker is loaded with a horn having a horn angle, and the truncation surface is defined by an intersection of the walls of the cone and a cone formed at the horn angle.

In an exemplary embodiment, the slits generally have an equal aperture area anywhere between the spherical surface and the truncation surface and define generally equal acoustic path lengths. The area of the slits may increase from the spherical surface to the truncation surface. In the exemplary arrangement, the slits diverge outwardly towards the cone wall and the truncation surface.

BRIEF DESCRIPTION OF THE DRAWINGS

FIG. 1 is a front perspective view of the compression driver or phase plug according to an exemplary embodiment of the invention;

FIG. 2 is a rear perspective of the phase plug illustrated in FIG. 1;

FIG. 6 is a cross section taken along line 6—6 of FIG. 4;

FIG. 6A is a side elevation of a mold segment defining a slit;

DETAILED DESCRIPTION OF THE INVENTION

Figure 3:
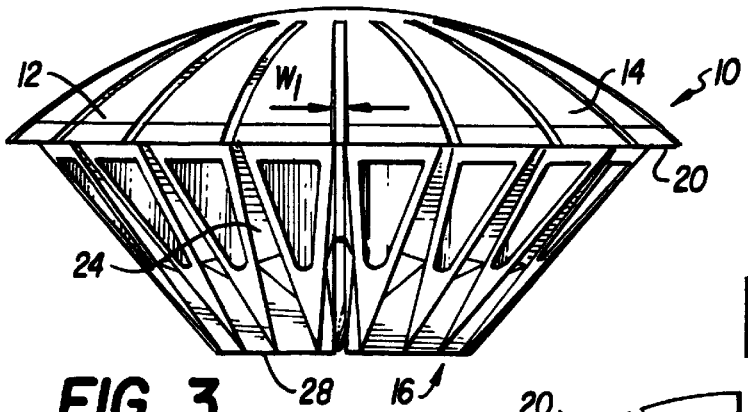
FIG. 3 is a side elevation of the phase plug illustrated in FIG. 1.
Figure 4:
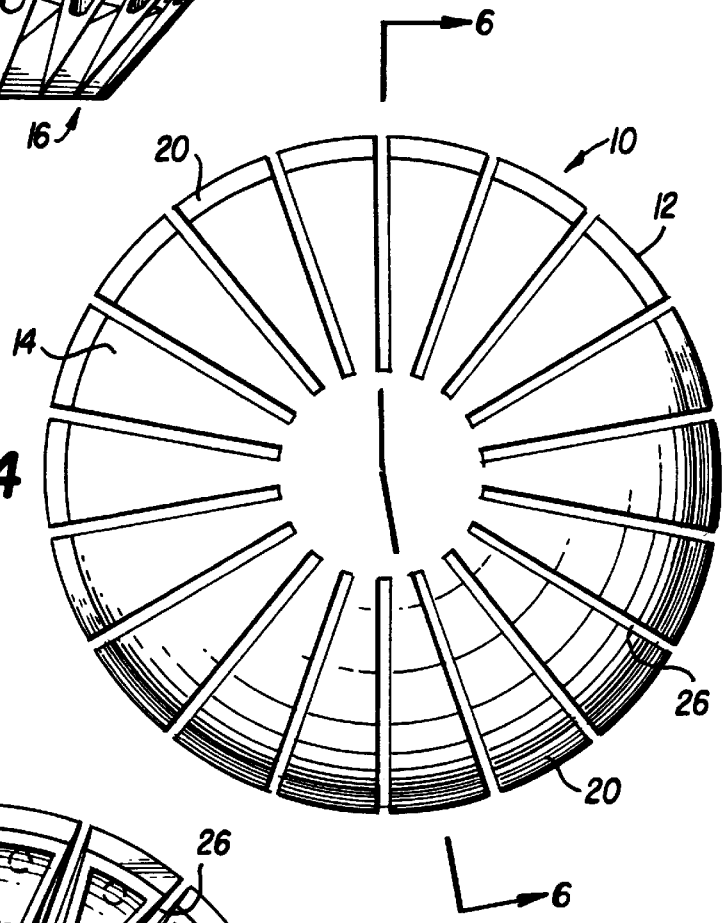
FIG. 4 is a front elevation of the phase plug illustrated in FIG. 1.
Figure 5:
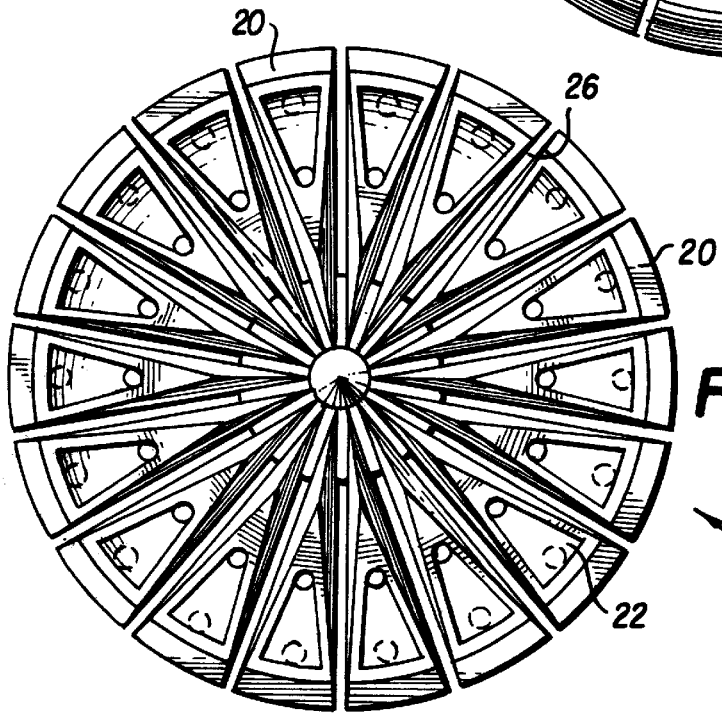
FIG. 5 is a rear elevation of the phase plug illustrated in FIG. 1.

FIGS. 1–6A illustrate a compression driver or phase plug 10 in accordance with an embodiment of the invention. The phase plug 10 is generally in the form of a molded body 12 having a frustro-conical shape. The body 12 has a spherical input or entrance surface 14, a planar output or truncation surface 16 and an intermediate conical side wall 18. The side walls lie at an angle with respect to the central or acoustic axis AO defining the cone angle θc (FIG. 6). The side wall 18 is perpendicular to the spherical entrance surface and provides an acoustic path which is generally equal for all frequences, thereby reducing destructive interference.

The spherical surface 14 has a flange portion 20 for positioning of the plug 10 in a horn loaded speaker as hereinafter described. The side wall 18 of the body 12 may be formed with molding recesses 22 to reduce weight. The acoustic axis A extends from the entrance surface 14 to the outlet 16.

The body 12 is formed with a plurality of radial slits which are in the form of tangerine-like sections forming channels 24 between the input entrance surface 14 and the outer surface 16. At the input surface 14 the channels 24 have a generally uniform width W1 and form rectangular openings or slits 26. In the entrance surface, the slits 26 define an aperture area which is roughly 1/10 the total area of the spherical entrance surface 14.

The channels 26 generally retain the width W1 from the entrance surface 14 to outlet surface 16 along the inner margin. However, the channels 24 diverge outwardly to a width W2 near the truncation surface 16, as shown, forming triangular openings 28 or apertures thereat. The triangular openings 28 at the truncation surface 16 occupy a much larger percentage of the area thereof and have a total aperture area greater than or equal to the aperture area of the slits 26 in the entrance surface 14. The aperture area represented by the channels 24 at any cross-section between the entrance 14 and the outlet 16 is normally no less than the aperture area of the slits 26 in the entrance surface. As a result, channels 24 are formed which allow acoustic energy to pass through the plug 10 without interference.

The channels are formed by a number of surfaces. In the embodiment illustrated, the body 12 is formed by a molding process. Accordingly, the mold is formed with surface portions for producing the channel geometry. In the embodiment illustrated in FIG. 6, the channels are formed in the body 12 by a first radial slice 30 having a radius R. A second radial slice 32 having the same radius R is formed in the body 10, as shown. A third radial slice 36 is formed in body 12 likewise having a radius R. A straight fourth cut along line 38 is formed as shown. The first cut 30 is generally of uniform width W1. Cuts 32 and 36 diverge outwardly as does cut 38. The various defining lines 32, 36, and 38 are softened in the final mold to provide a smooth transition through the channel 24. A profile of the cuts is shown in FIG. 6A as a portion of the mold segment.

As illustrated in FIGS. 2 and 6, the truncation surface resembles a plurality of radial fins 40 emanating from a conical tip 42 and having an annular opening 44 as shown. The apertures 22 formed in the conical wall 18, as shown in FIG. 6, reduces weight and mold cooling time.

Figure 7A:
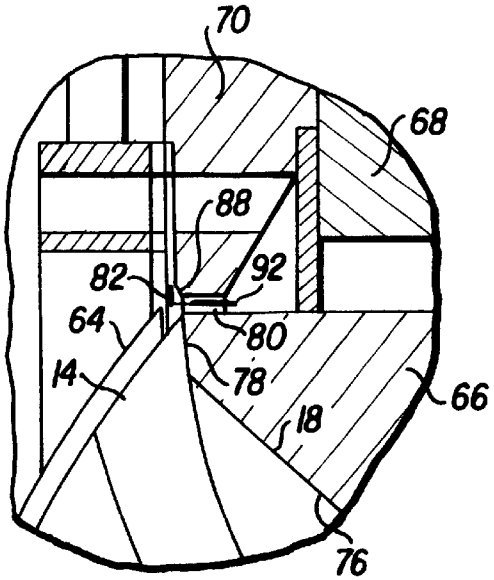
FIG. 7A is a fragmentary enlargement of a portion of the loud speaker shown in FIG. 7.
Figure 7:
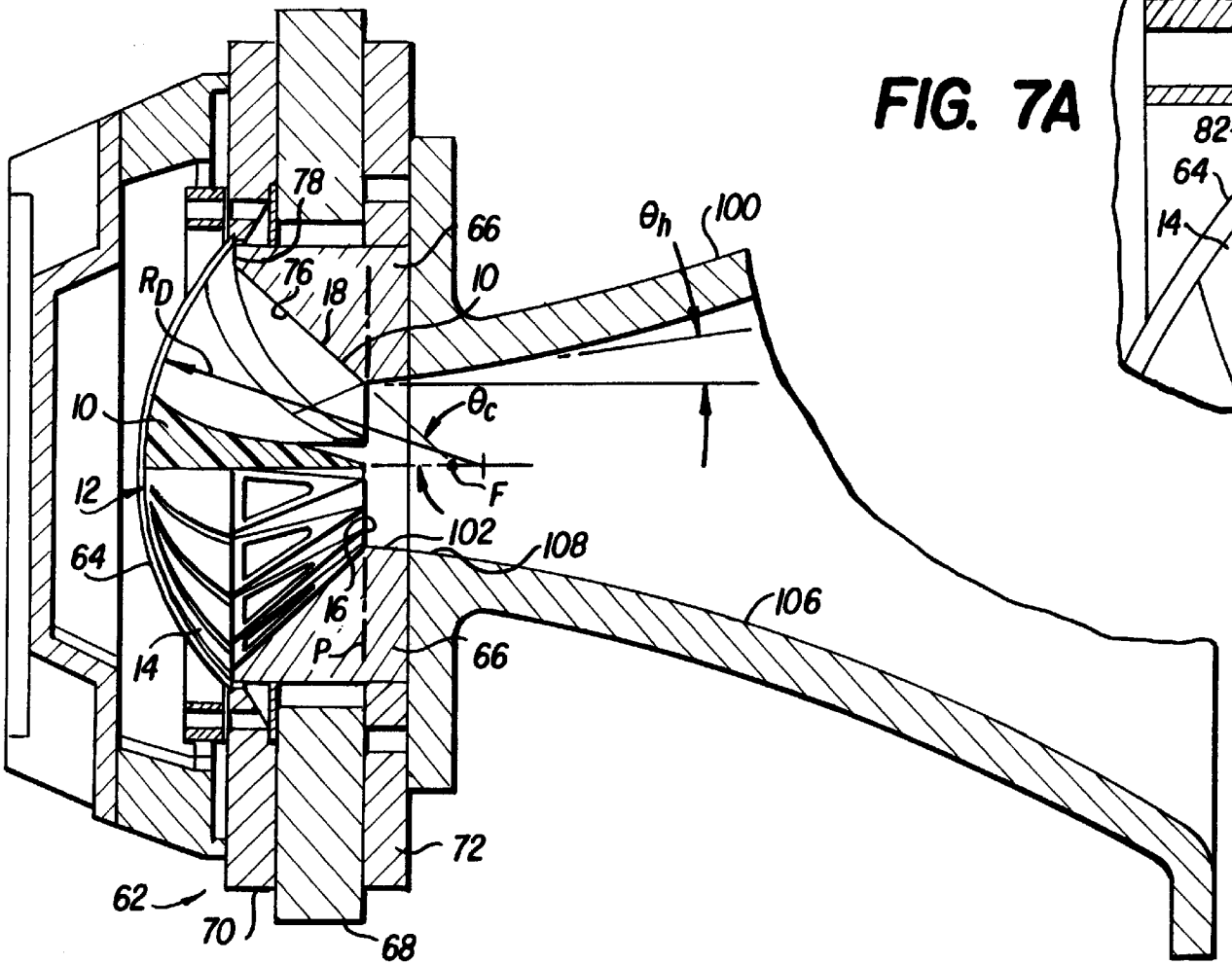
FIG. 7 is a fragmentary schematic sectional drawing illustrating a phase plug of the present invention incorporated into a horn loaded loud speaker with a spherical diaphragm.

FIG. 7 illustrates an embodiment of the invention in which horn loaded loud speaker 60 is equipped with the phase plug 10 of the invention and a horn 70. The loud speaker 60 includes a magnet structure 62 and a diaphragm 64 mounted therein. In the exemplary embodiments, the diaphragm 64 has a spherical shape and the entrance surface 14 of the phase plug 10 is conformal therewith, as shown.

The magnetic structure 62 has an inner pole piece 66, a magnet 68, and front and back plates 70 and 72. The inner pole piece 66 has a conical sidewall 76 for receiving the phase plug 10 therein as shown. The sidewall 76 and the phase plug sidewall 18 are generally the same shape so that the phase plug is conformal within the inner pole piece 66 as shown. The inner pole piece 66 has an abutting surface 78 and the flange portion 20 of the phase plug 10 rests against said abutting surface 78 in the magnet 62 as shown. The phase plug 10 and the side wall 78, the inner pole piece 66 share the same cone angle θc.

In the exemplary embodiment, the inner pole piece 66 and the front plate 70 form an annular air gap 80. The diaphragm 64 has an radially extending ring 82 captured between inner and outer suspension rings in a recess 88 formed in the front plate and secured by a mounting ring and screws (not shown). Annular voice coil 92 is suspended by the diaphragm in the air gap 80.

As noted above, the sidewall 18 of the conical body 12 is perpendicular to the entrance surface 14 and is likewise, perpendicular to the diaphragm 64. In accordance with the invention, both the diaphragm 64 and the phase plug 10 share a common focal point F. Indeed, all points on the diaphragm and all points on the input surface 14 of the plug 10 share the same focal point F.

The loud speaker 60 has a horn 100 mounted to the back plate 72 of the magnet 62. The horn 100 has a horn angle $\phi_h$ defining a cone. Back plate 72 has a opening 102 which is a shaped extension of an interior surface 106 of the horn 100 at the proximal or inlet end 108.

In the exemplary embodiment, the geometry of the horn 100 and that of the phase plug 10 are related. The location of the truncation surface 16 is defined by the intersection of conical sidewall 18 and the extension of the inner surface 106 of the horn 100 disposed and a cone formed by the horn angle $\phi_h$. Thus, it can be seen that the open or aperture area of the outlet surface 16 corresponds to the open area of the proximal or inlet end 108 of the horn 100. The intersection of the two surfaces occurs along a plane P and the output or truncation surface of the body 12 lies in the same plane P as shown.

The compression driver or phase plug 10 of the invention increases the high frequency output. This is achieved by geometrically focusing the acoustic energy towards a central point where all the path lengths are substantially equal. The open aperture area of the channels 24 is such as to keep the open aperture area of the outlet openings 28 of the phase plug 10 equal to or greater than the open aperture area of the slits 26 at the input or entrance 14. In the exemplary embodiment, the channel area may increase slightly towards the outlet 16.

In accordance with the invention, the length of the truncated cone of the body 12 is determined by first drawing a tangent line from the outer limits of the diaphragm radius straight to the focal point F creating cone angle θc. The throat or horn angle $\phi_h$ of the horn 70 is then extended until it defines a cone intersecting the phase plug cone angle θc. This intersection between the two cones defines a plane P where truncation is applied to the phase plug. The exit area or outlet 16 of the phase plug 10 has the sharply defined cone shaped center 42 with the annular area 44 around the cone opened to the acoustic fins 45. This affects the acoustic energy with a minimum of internal diffraction. Thus, the invention converts a spherical wave created by the diaphragm to a plane wave at the entrance of the horn while increasing the high frequency response of the compression driver. Accordingly, an important aspect of the invention is that it employs a dual focus system wherein the diaphragm and phase plug have the same focal point.

The invention also provides for minimum diffraction by focusing acoustic energy centrally through the channels 24. The phase plug of the invention having the general shape of a dome on one side and the truncated cone on the other may be described as being focused or centered on the geometric center of a sphere, with the outside limits of the cone wall 18 being perpendicular to the spherical surface 14 at the entrance and also perpendicular to the spherical diaphragm 64.

The invention concentrates all the acoustic energy to a central point and truncation of the cone is defined by the entrance to the horn throat. In other words, truncation is applied at the point in space where the consolidated area of the channels within the phase plug is equivalent to a throat cross sectional area of the horn.

Further, in accordance with the invention it can be seen that the entrance 14 of the phase plug 10 is broken down into multiple segments 26 creating a relatively high compression ratio of about 10 to 1, that is, the area of the spherical surface 14 and the area of the slits 26 is approximately in the ratio of 10 to 1. The outlet 16 of the phase plug 10 has been optimized to keep the open area equal to or greater than the open area of the entrance. This exit area is likewise equal to the entrance to the horn. The internal open air volume channels 24 within the phase plug has been shaped to create the focusing effect of the acoustic wave as it propagates through the plug. The reason for this is to convert a spherical wave to a plane wave prior to the acoustic energy arriving at the throat of the horn and without generating an acoustical reflection within the plug. This, in turn, prevents an impedance mismatch as well as focuses the acoustic energy throughout the frequency range and particularly the high frequency range. The truncated cone is focused on the center of the sphere represented by the diaphragm with the length of the cone determined by the intersection of the horn entrance and the cone angle on the acoustic axis. The surfaces of the mold forming the channels are smoothed along the boundaries to prevent acoustic interference. The cone may be molded, for example, from polyester or other suitable material.

While there have been described what are at present considered to be the preferred embodiments of the present invention, it will be apparent to those skilled in the art that various changes and modifications may be made therein without departing from the invention, and it is intended in the appended claims to cover such changes and modifications as fall within the spirit and scope of the invention.

What is claimed:

1. A sound translating device for a horn loaded speaker with a spherical diaphragm comprising, a body having a longitudinal axis and a plurality of slots formed therein, said body having an entrance surface defining a portion of a spherical surface, said body having a planar outlet surface disposed substantially perpendicular to said axis, said body also having a frusto-conical surface of a cone extending between said entrance surface and said outlet surface, the center of said spherical surface and the apex of said cone coinciding with one another, every line lying in said frusto-conical surface and coplanar with said axis being perpendicular to a plane tangent to the spherical surface at the point of intersection of the line and the spherical surface, each of said slots having opposite ends which open at said entrance surface and said outlet surface to define open aperture areas at said entrance surface and said outlet surface, said outlet surface having an open aperture area greater than or equal to the open aperture area of said entrance surface.

2. The device of claim 1 wherein said slots have an equal aperture area taken in a plane normal to the longitudinal axis anywhere between the entrance surface and the outlet surface.

3. The device of claim 1 wherein said slots have an aperture area taken in a plane normal to the longitudinal axis increasing from the entrance to the outlet.

4. A sound translating device for a horn loaded speaker with a spherical diaphragm comprising, a body having a longitudinal axis and a plurality of slots formed therein, said body having an entrance surface defining a portion of a spherical surface, said body having a planar outlet surface disposed substantially perpendicular to said axis, said body also having a frusto-conical surface of a cone extending between said entrance surface and said outlet surface, the center of said spherical surface and the apex of said cone coinciding with one another, each of said slots having opposite ends which open at said entrance surface and said outlet surface to define open aperture areas at said entrance surface and said outlet surface, the outlet surface having an open aperture area greater than or equal to the open aperture area of said entrance surface, each of said slots being formed between a pair of spaced opposing walls, each pair of opposing walls being symmetrically disposed about a plane containing said axis, each wall having an inner edge adjacent to and spaced from said axis, said inner edge having a curved portion adjacent to said entrance surface and a linear portion adjacent to said outlet surface.

5. The device of claim 4 wherein said slots have an equal aperture area taken in a plane normal to the longitudinal axis anywhere between the entrance surface and the outlet surface.

6. The device of claim 4 wherein said slots have an aperture area taken in a plane normal to the longitudinal axis increasing from the entrance surface to the outlet surface.

7. The device of claim 4 wherein the spaced opposing walls of each slot diverge from each other toward the frusto-conical surface and diverge from each other toward the planar outlet surface.

8. The device of claim 3 wherein the linear portions of each said inner edge, taken together, define a cylinder having an axis co-linear with the longitudinal axis.

9. The device of claim 8 further comprising an inner cone coaxial with and within said cylinder.

10. A sound translating device for a horn loaded speaker with a spherical diaphragm comprising, a body having a longitudinal axis and a plurality of slots formed therein, said body having an entrance surface defining a portion of a spherical surface, said body having a planar outlet surface disposed substantially perpendicular to said axis, said body also having a frusto-conical surface of a cone extending between said entrance surface and said outlet surface, the center of said spherical surface and the apex of said cone coinciding with one another, every line lying in said frusto-conical surface and coplanar with said axis being normal to the spherical surface, each of said slots having opposite ends which open at said entrance surface and said outlet surface to define open aperture areas at said entrance surface and said outlet surface, said outlet surface having an open aperture area greater than or equal to the open aperture area of said entrance surface.

* * * * *